US010741907B2

(12) United States Patent
Krueger et al.

(10) Patent No.: US 10,741,907 B2
(45) Date of Patent: Aug. 11, 2020

(54) LIGHTWEIGHT SPIRAL ANTENNA ARRAY PACKAGING APPROACH

(71) Applicant: BAE SYSTEMS Information and Electronic Systems Integration Inc., Nashua, NH (US)

(72) Inventors: Michael J. Krueger, Bedford, NH (US); Frank D. Phillips, Bedford, NH (US); Scott M. Willcutt, Tilton, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 143 days.

(21) Appl. No.: 16/195,984

(22) Filed: Nov. 20, 2018

(65) Prior Publication Data

US 2020/0161751 A1 May 21, 2020

(51) Int. Cl.
*H01Q 1/40* (2006.01)
*H01Q 1/36* (2006.01)

(52) U.S. Cl.
CPC ..... *H01Q 1/40* (2013.01); *H01Q 1/36* (2013.01)

(58) Field of Classification Search
CPC ..... H01Q 1/40; H01Q 1/36
USPC ..... 343/873
See application file for complete search history.

(56) References Cited

U.S. PATENT DOCUMENTS

| | | | | | |
|---|---|---|---|---|---|
| 3,713,167 | A * | 1/1973 | David | H01Q 3/24 | 343/797 |
| 3,745,585 | A * | 7/1973 | Barbano | H01Q 1/36 | 343/792.5 |
| 7,450,071 | B1 * | 11/2008 | Volman | H01Q 1/02 | 343/700 MS |
| 8,081,118 | B2 * | 12/2011 | McCarthy | H01Q 9/0414 | 343/700 MS |
| 8,587,482 | B2 * | 11/2013 | Liu | H01Q 1/2283 | 343/700 MS |
| 9,099,777 | B1 * | 8/2015 | Manry, Jr. | H01Q 1/288 | |
| 10,665,961 | B1 * | 5/2020 | McMahon | H01Q 3/38 | |
| 2010/0207838 | A1 * | 8/2010 | Chiu | H01Q 1/20 | 343/873 |
| 2015/0276459 | A1 * | 10/2015 | Sai | H01Q 1/36 | 73/290 V |
| 2018/0048061 | A1 * | 2/2018 | Brigham | H01Q 13/085 | |
| 2020/0014121 | A1 * | 1/2020 | Maccabe | H01Q 21/061 | |

* cited by examiner

*Primary Examiner* — Hai V Tran
(74) *Attorney, Agent, or Firm* — Davis & Bujold, PLLC

(57) ABSTRACT

The system and method for lightweight spiral antenna array packaging uses a foam core and metallic elements such that the foam core is machined to accept the folded metallic elements to create a compact and light weight assembly. The assembly can be bonded to other assemblies to form arrays. The array is then encapsulated in a prepreg fiberglass skin with a conductive layer of fabric/screen therein.

14 Claims, 13 Drawing Sheets

LIGHTWEIGHT SPIRAL ANTENNA ARRAY PACKAGING APPROACH

STATEMENT OF GOVERNMENT INTEREST

This disclosure was made with United States Government support under Contract No. FA8620-11-G-4029 awarded by United States Air Force. The United States Government has certain rights in this disclosure.

FIELD OF THE DISCLOSURE

The present disclosure relates to antenna arrays and more particularly to a lightweight packaging method for a spiral antenna array.

BACKGROUND OF THE DISCLOSURE

Traditional packaging of cavity backed antenna elements into an array involves securing each element and its feed onto a rigid non-conductive support structure. The cavity behind the radiating element is typically required to be metal for reflective purposes. It is also important that the cavity does not touch the conductive elements. Unfortunately, a metal cavity is heavy and is limited to simple shapes. Large arrays with metal cavities are heavy and require more support structure to keep stresses and deflections low.

Wherefore it is an object of the present disclosure to overcome the above-mentioned shortcomings and drawbacks associated with the conventional packaging methods for antenna arrays.

SUMMARY OF THE DISCLOSURE

One aspect of the present disclosure is a system comprising antenna elements which are ganged together into lightweight arrays skinned by fiberglass. This approach allows an array be scaled up or down in physical size as well as the quantity of elements required to meet the performance needs. A flexible RF feed assembly embedded and co-cured inside of the fiberglass structure capable of withstanding high processing temperatures eliminates multiple assembly steps and solder joint stresses.

Another aspect of the present disclosure is a lightweight spiral antenna array packaging method, comprising: bonding foam as layers to form a foam structure; machining features into the foam structure to create a plurality of element mounting structures; forming a plurality of metallic elements to fit the plurality of element mounting structures; bonding the plurality of metallic elements to the plurality of element mounting structures; assembling the plurality of element mounting structures into an antenna structure; bonding a feed tube into position within the antenna structure; installing a feed assembly into the feed tube; soldering the plurality of metallic elements to a matching plurality of center connectors within the feed assembly; assembling a plurality of antenna structures together to form a multi-antenna array; surrounding the multi-antenna array in a perimeter foam layer; encapsulating the multi-antenna array in a continuous fiberglass prepreg/metalized fabric layer; autoclaving the multi-antenna array to cure the multi-antenna array into an inseparable antenna assembly; trimming the inseparable antenna assembly to create a mounting flange; and installing grommets into the mounting flange for use in mounting the inseparable antenna assembly.

One embodiment of the lightweight spiral antenna array packaging method is wherein the foam is polymethacrylimide (PMI).

Another embodiment of the lightweight spiral antenna array packaging method is wherein the metallic elements are the copper foil which is 0.005 inches thick.

Yet another embodiment of the lightweight spiral antenna array packaging method is wherein the plurality of metallic elements is four and the plurality of antenna structures is three. In some cases, bonding uses an adhesive.

Still yet another embodiment of the lightweight spiral antenna array packaging method further comprises testing the inseparable antenna assembly. In some cases, the lightweight spiral antenna array packaging method further comprises painting the inseparable antenna assembly.

Another aspect of the present disclosure is a lightweight spiral antenna array package, comprising: a foam structure comprising bonded foam layers, the foam structure having machined features to create a plurality of element mounting structures; a plurality of metallic elements formed to fit the plurality of element mounting structures, where the plurality of metallic elements are bonded to the plurality of element mounting structures; and the plurality of element mounting structures are assembled into an antenna structure; a feed tube bonded into a position within the antenna structure with a feed assembly within the feed tube; the plurality of metallic elements are soldered to a matching plurality of center connectors within the feed assembly; the antenna structure is surrounded by a perimeter foam layer and encapsulated in a continuous fiberglass prepreg/metalized fabric layer.

One embodiment of the lightweight spiral antenna array package further comprises a plurality of antenna structures assembled together to form a multi-antenna array, which is autoclaved to cure the a plurality of antenna structures into an inseparable multi-antenna array.

Another embodiment of the lightweight spiral antenna array package further comprises a mounting flange comprising grommets for use in mounting the inseparable antenna assembly.

Still another embodiment of the lightweight spiral antenna array package is wherein the foam is polymethacrylimide (PMI). In some cases, the metallic elements are the copper foil which is 0.005 inches thick.

Still yet another embodiment is wherein the plurality of metallic elements is four and the plurality of antenna structures is three. In some cases, bonding uses an adhesive.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

In one embodiment of the present disclosure, a lightweight rigid metallic acting fiberglass packaging approach is used. This lightweight inseparable assembly requires less support and structure. The packaging approach allows the designer to scale the physical size and quantity of individual elements up or down into many configurations depending on the performance needs.

In certain embodiments of the packaging method for an RF antenna array, an RF cable feed assembly for the elements is flexible and is embedded inside the structure and survive high processing temperatures. In some embodiments, the RF feed assembly can be co-cured into the cavity structure eliminating assembly steps and solder joint stress.

In the antenna packaging of the present disclosure, aggressive weight and size restrictions were imposed on the design such that the final solution was about 23% (about 8 pounds) lighter than an original design concept using traditional assembly methods and materials. One embodiment of the mechanical packaging approach described herein is a lightweight and rigid design that allows a simple continuous copper foil element to be folded into a three dimensional shape. In some cases, the copper foil element is water jet cut from thin copper sheet. This approach eliminated the need for a flex circuit.

In one embodiment, support for the element was provided by a foam core which was machined into a cube and was configured to accept a cable feed assembly. In certain cases, each cube has four elements and three cubes are bonded together to form a twelve element "array." A radio frequency (RF) cable feed assembly was incorporated into each four element "cube." The cable feed assembly in certain embodiments is embedded into a structure providing flexibility to relieve solder joint stresses at the element feed point.

In another embodiment of the present disclosure the entire three-cube (twelve elements) assembly is encased in a fiberglass shell giving it stiffness. Embedded in the fiberglass layup is a continuous conductive metalized fabric that picks up the connector feed assemblies and metal mounting hardware (e.g., grommets) and provides grounding for the antenna. In one example, the metal fabric "looks" like a metal cavity electrically but at a fraction of the weight of a comparable aluminum structure. In one embodiment, the entire assembly (structural core, elements, and RF feed assembly) is cured in a single autoclave operation producing a rugged, sealed, inseparable assembly.

The packaging approach of the present disclosure can be scaled up or down as well as accommodate a wide range of different element shapes that need to be folded three dimensionally for space savings and performance reasons. The concept is "modular" and can be combined into a variety of arrays.

Figures 1A, 1B:
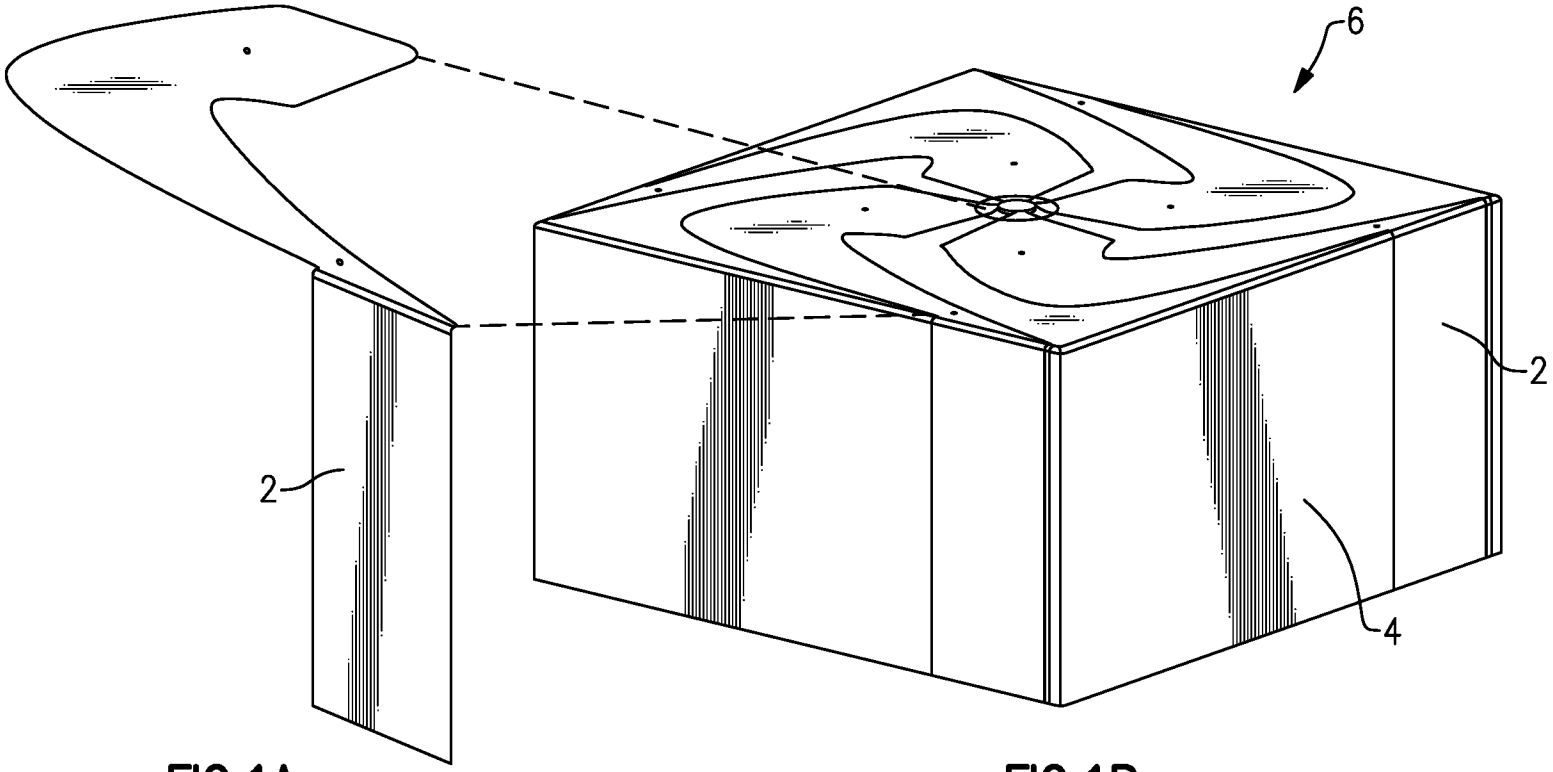
FIG. 1A shows a diagrammatic view of one embodiment of an antenna element according to the principles of the present disclosure.
FIG. 1B shows a diagrammatic view of one embodiment of a multi-element cube according to the principles of the present disclosure.

Referring to FIG. 1A, a diagrammatic view of one embodiment of a four element sub-array according to the principles of the present disclosure is shown. More specifically, one embodiment of the antenna element 2 is a copper foil, which is folded and bonded to a foam core. The RF feed point for the individual elements originates at the center of the foam core. In one example, the copper foil is 0.005 inches thick.

Referring to FIG. 1B, a diagrammatic view of one embodiment of a multi-element cube according to the principles of the present disclosure is shown. More specifically, a foam core 4 is used to support each element 2. In one embodiment, the foam comprises polymethacrylimide (PMI). In this embodiment, four elements and a foam core are combined together to form a cube 6.

Figure 2B:
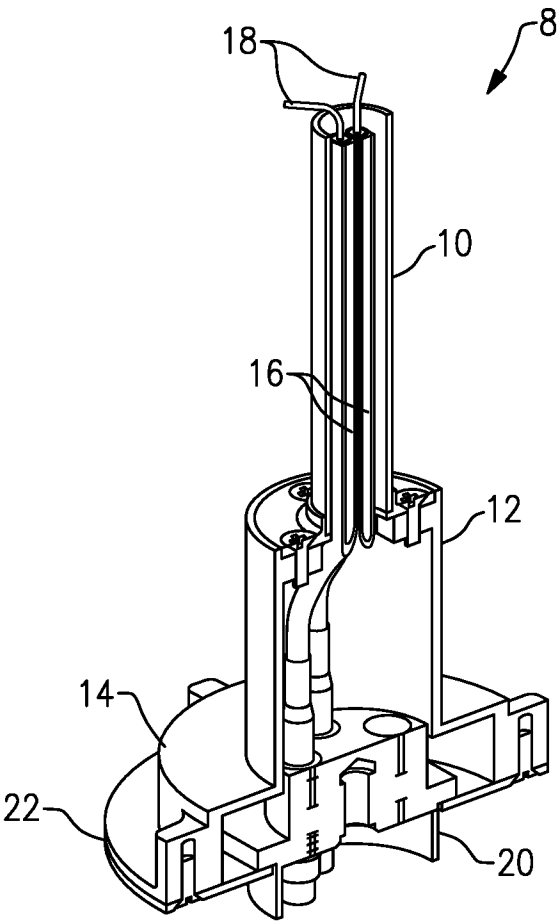
FIG. 2B shows a cross-sectional view of one embodiment of a feed supply according to the principles of the present disclosure.
Figure 2A:
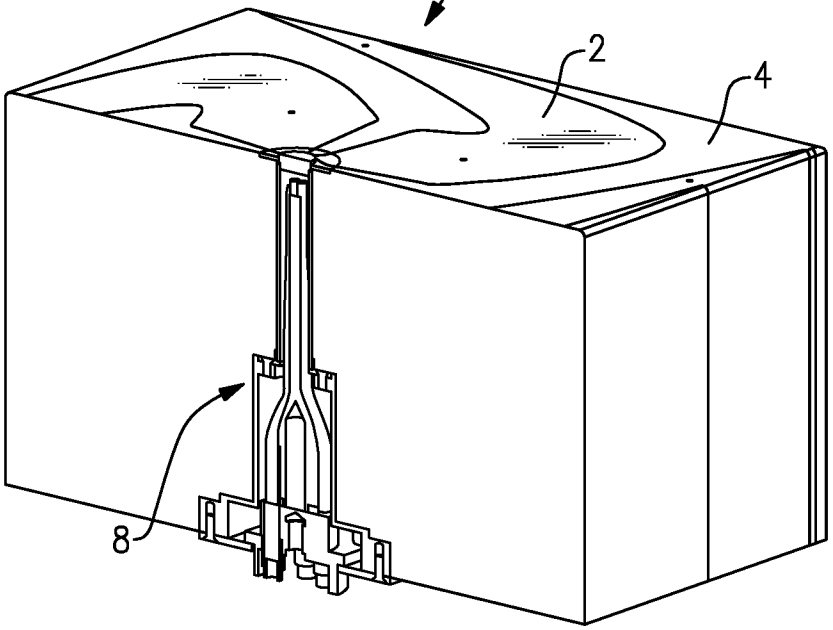
FIG. 2A shows a cross-sectional view of one embodiment of a multi-element cube and feed supply according to the principles of the present disclosure.

Referring to FIG. 2A, a cross-sectional view of one embodiment of a multi-element cube and feed assembly according to the principles of the present disclosure is shown. More specifically, foam core 4 is used to support each element 2 and in this embodiment four elements are bonded to a foam core to form a cube 6. A feed assembly 8 is inserted and bonded into the foam cube 6 providing for connection to each of the elements 2 in the antenna.

Referring to FIG. 2B, a cross-sectional view of one embodiment of a feed supply according to the principles of the present disclosure is shown. More specifically, an aluminum feed housing 10, 12, 14 and 22 is used to hold and position the components in the RF feed assembly 8. The connector plate 22 on a bottom surface accurately positions and secures 20 the connector shell that houses the individual RF cables 16. Additionally, the cavity within the housing allows each the individual cables 16 room to move slightly/flex and not be over constrained during vibration events and thermal excursions causing solder joint stress at the critical feed point between the center conductor 18 and respective element 2. In one embodiment, there are four cables 16 (in cross-section only see two) which when installed into a "cube" or other shape, each center conductor is bent 18 and soldered to a respective element feed point. Item 38 on the top surface (See, FIG. 3B) is a non-conductive cap that accurately positions and orients the cable center conductors 18 and ensures they do not touch the feed housing 10 which is conductive.

Figure 2E:
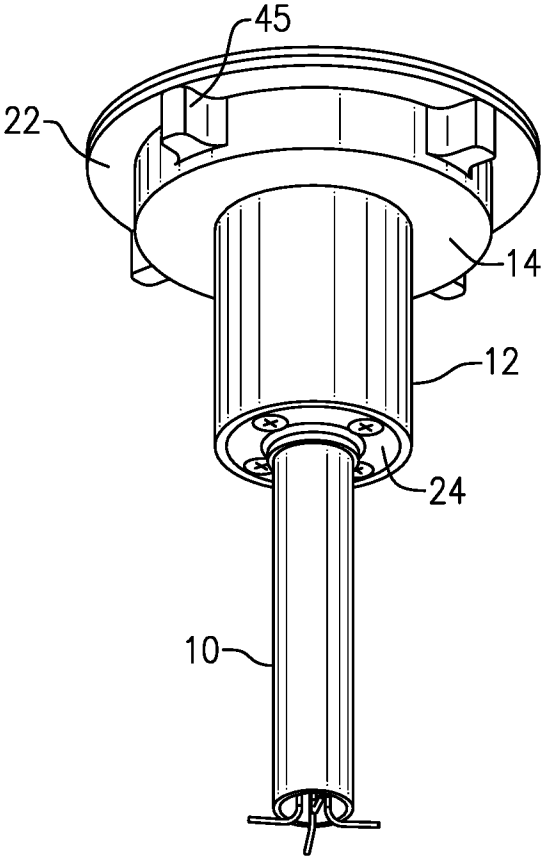
FIG. 2E shows a perspective view of one embodiment of a feed supply according to the principles of the present disclosure.
Figure 2C:
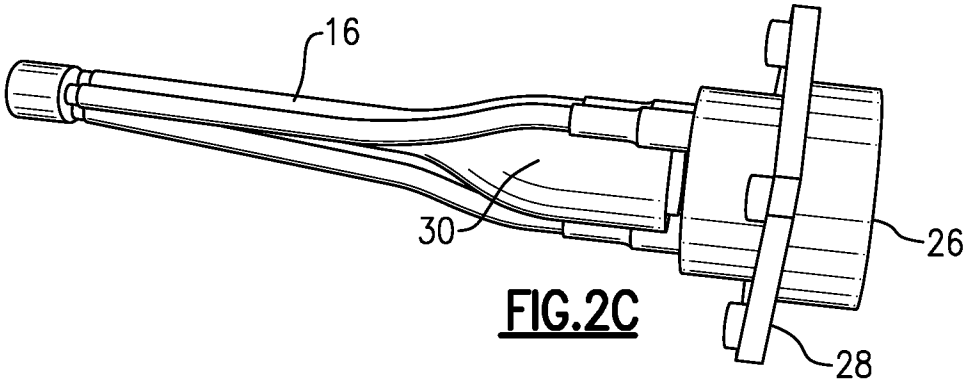
FIG. 2C shows a perspective view of a partially assembled feed supply according to the principles of the present disclosure.

Referring to FIG. 2C, a perspective view of a partially assembled feed supply according to the principles of the present disclosure is shown. More specifically, in this embodiment there are four cables 16 connected via a connector shell 26 and connector plate 28.

Figure 2D:
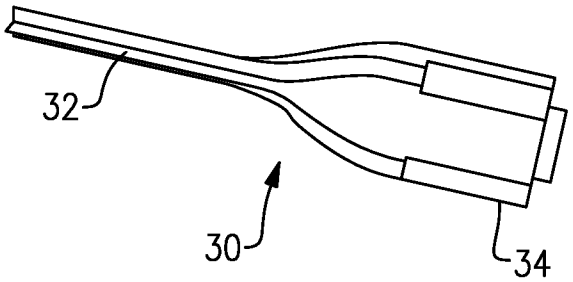
FIG. 2D shows a perspective view of one embodiment of a cable spline for a feed supply according to the principles of the present disclosure.

Referring to FIG. 2D, a perspective view of one embodiment of a cable spline for a feed supply according to the principles of the present disclosure is shown. More specifically, a cable spline 30 is used to provide support for the various RF cables 16. In one example, the cable spline 30 is produced using additive manufacturing. An electrically conductive heat shrink is used (not shown) to pull the bale bundle tightly together onto the cable spline each at 90 degrees apart relative to each other allowing the 4 cable shields to be in contact with each other. This forms a "tube" around the cables toward the far end of the cable spline 32. This conductive heat shrink resembles a small metallic tube (electrically) further enhancing antenna performance. Cables transition and neck down to the bale bundle in channels 34 guiding the cable 16 along the body of the spline. A hinge point (in the area of 30) allows the individual cables to move slightly (mentioned above) since the cable is restrained at the center conductor and connector shell ends.

Referring to FIG. 2E, a perspective view of one embodiment of a feed supply according to the principles of the present disclosure is shown. More specifically, the assembled RF feed assembly is configured to withstand a 250° F. autoclave cure step at the next higher stage of assembly with the foam core. Items 10, 24, 12, 14 make up the feed assembly body and provide the bonding surface to the core at the next higher assembly. Tabs 45 prevent the feed assembly from rotating within the foam cube at the next higher assembly when a mating connector is installed. These tabs have corresponding features machined into the foam core (see FIG. 3A).

Figure 3B:
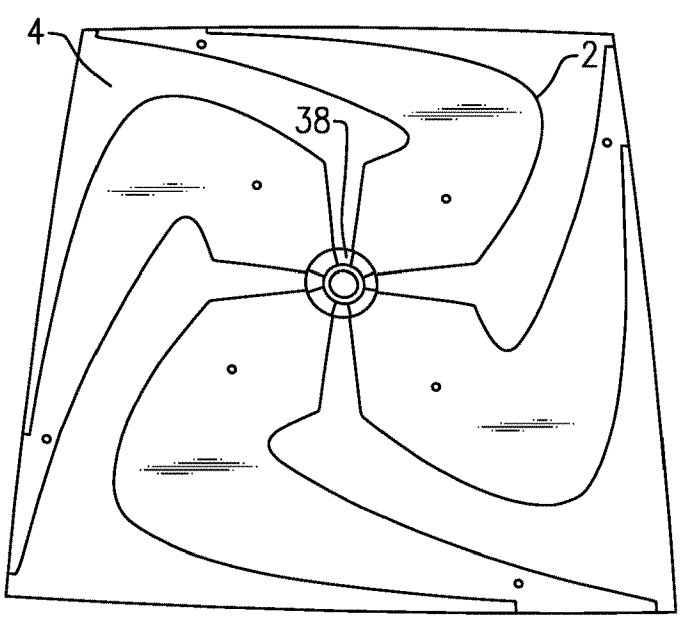
FIG. 3B shows a perspective view of one embodiment of antenna elements and feed supply bonded in place according to the principles of the present disclosure.
Figure 3A:
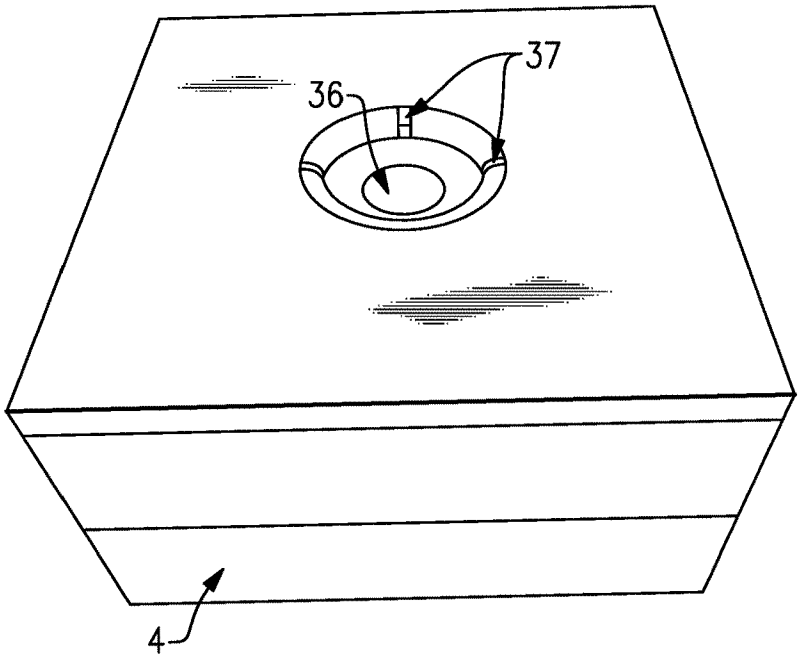
FIG. 3A shows a perspective view of one embodiment of foam bonded layers with machined features according to the principles of the present disclosure.

Referring to FIG. 3A, a perspective view of one embodiment of foam bonded layers with machined features according to the principles of the present disclosure is shown. More specifically, layers of foam 4 are assembled together to form a foam core cube. In one embodiment, the core has a machined cavity 36 to accept the corresponding RF feed assembly. In certain embodiments, the feed assembly is bonded into the core with a film adhesive, or the like. In certain embodiments, anti-rotation features 37 are machined to match the feed assembly). In one embodiment, individual sheets are bonded together like a layer cake (with film adhesive) to make the basic cube. Here, there are three layers. After the film adhesive is cured, it (the block/cube) is then machined to final shape.

Referring to FIG. 3B, a perspective view of one embodiment of antenna elements and feed tube bonded in place according to the principles of the present disclosure is shown. More specifically, once the core 4 has been assembled and machined to accept the feed supply, antenna elements and the feed tube are bonded in place. The elements 2 in this embodiment are 0.005" thick copper foil which had been prepared with a black oxide coating. The black oxide is to enhance bonding. An area at the very tips of the elements shows the area where the oxide coating (enhances bonding but not an acceptable soldering surface) on the elements has been removed. A fiberglass washer 38 is machined into the foam and under the elements. Its purpose is to support the foil during the soldering operation (the hot tip of the soldering iron could punch the foil into the foam).

Figure 3D:
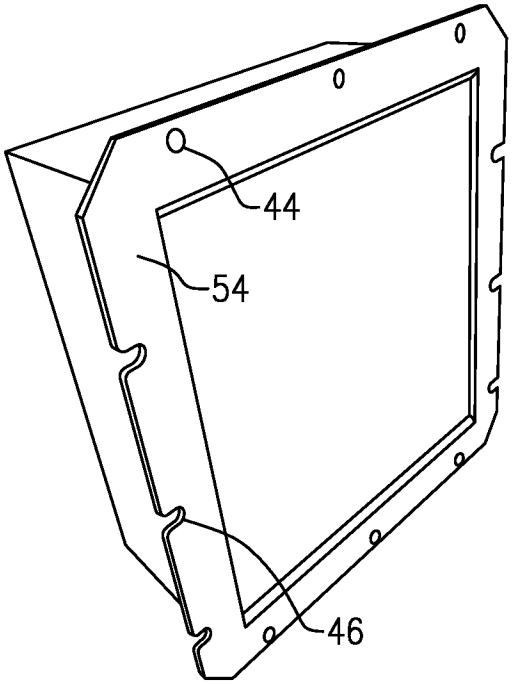
FIG. 3D shows a perspective view of one embodiment of encapsulated foam block machined and with grommets according to the principles of the present disclosure.
Figure 3C:
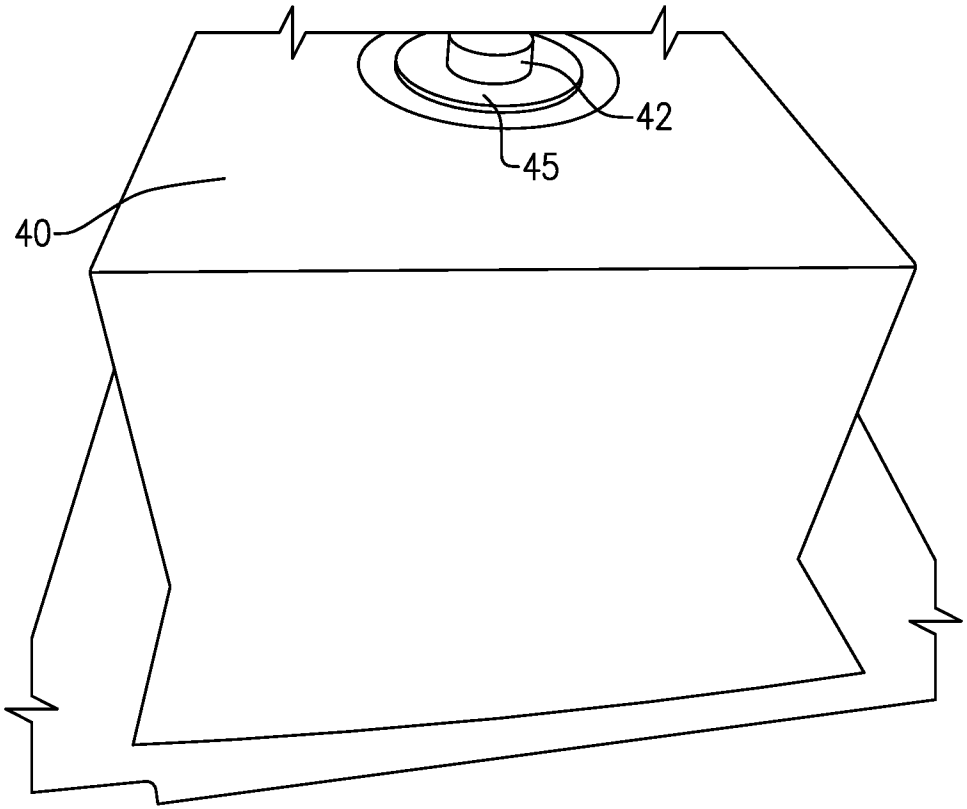
FIG. 3C shows a perspective view of one embodiment of foam block encapsulated and cured according to the principles of the present disclosure.

Referring to FIG. 3C, a perspective view of one embodiment of foam block encapsulated and cured according to the principles of the present disclosure is shown. More specifically, the foam block is encapsulated with fiberglass prepreg 40 and cured. Prepreg is short for "pre-impregnated" composite fibers where a thermoset polymer matrix material, such as epoxy, or a thermoplastic resin is present. The fibers often take the form of a weave and the matrix is used to bond them together and to other components during manufacture.

Referring to FIG. 3D, a perspective view of one embodiment of an encapsulated foam block machined and with grommets according to the principles of the present disclosure is shown. More specifically, a flange shape 54 is machined and the antenna is surface painted. Additionally, metal grommets 44 with captive stud bolts are installed to provide connectivity when the antenna is installed. In certain embodiments, a metallized fabric is used within the encapsulation step to provide a consistent grounding approach to the fabric/grommet interface and provides grommet to grommet continuity. This further provides continuity between the grommet and the connector plate of the feed supply. In some cases, slots 46 are also machined into the flange to provide connection points when installing the antenna.

Figure 4:
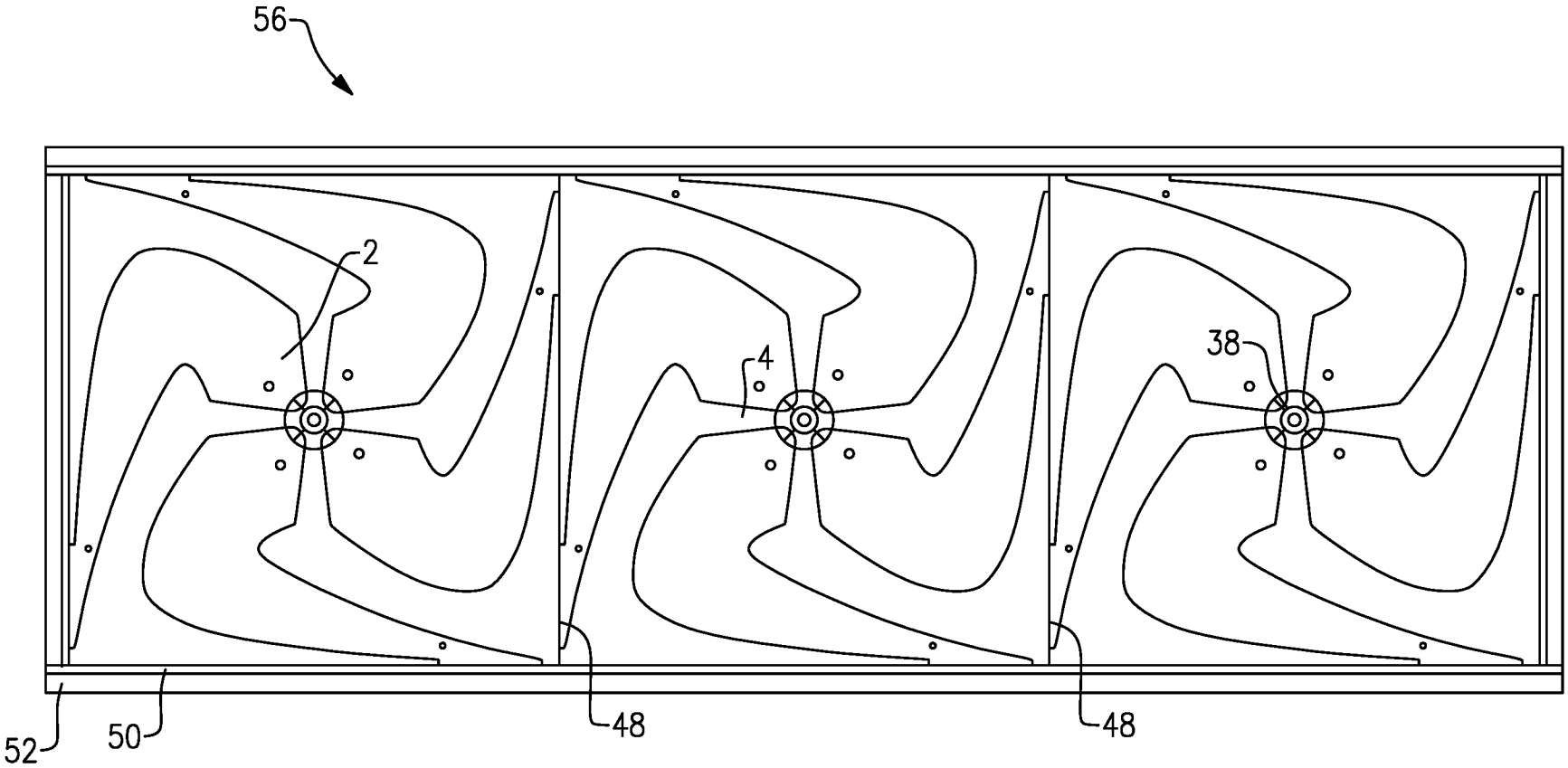
FIG. 4 shows a diagrammatic top view of a three-cube assembly according to the principles of the present disclosure.

Referring to FIG. 4, a diagrammatic top view of a three-cube assembly (fiberglass not shown) according to the principles of the present disclosure is shown. More specifically, a three-cube assembly of elements 2 and foam core 4 are joined along shared surfaces 48. In some cases, they are bonded using a structural adhesive film. In one embodiment a foam layer 52 is bonded around the perimeter of the three-cube assembly providing a nonconductive gap between the elements 2 folded down the sides of the cube and the conductive fiberglass skin 50 installed in the next step with an adhesive film. In this figure, the solder connection point of each of the elements 2 in the antenna can be seen on a top surface.

Figure 5:
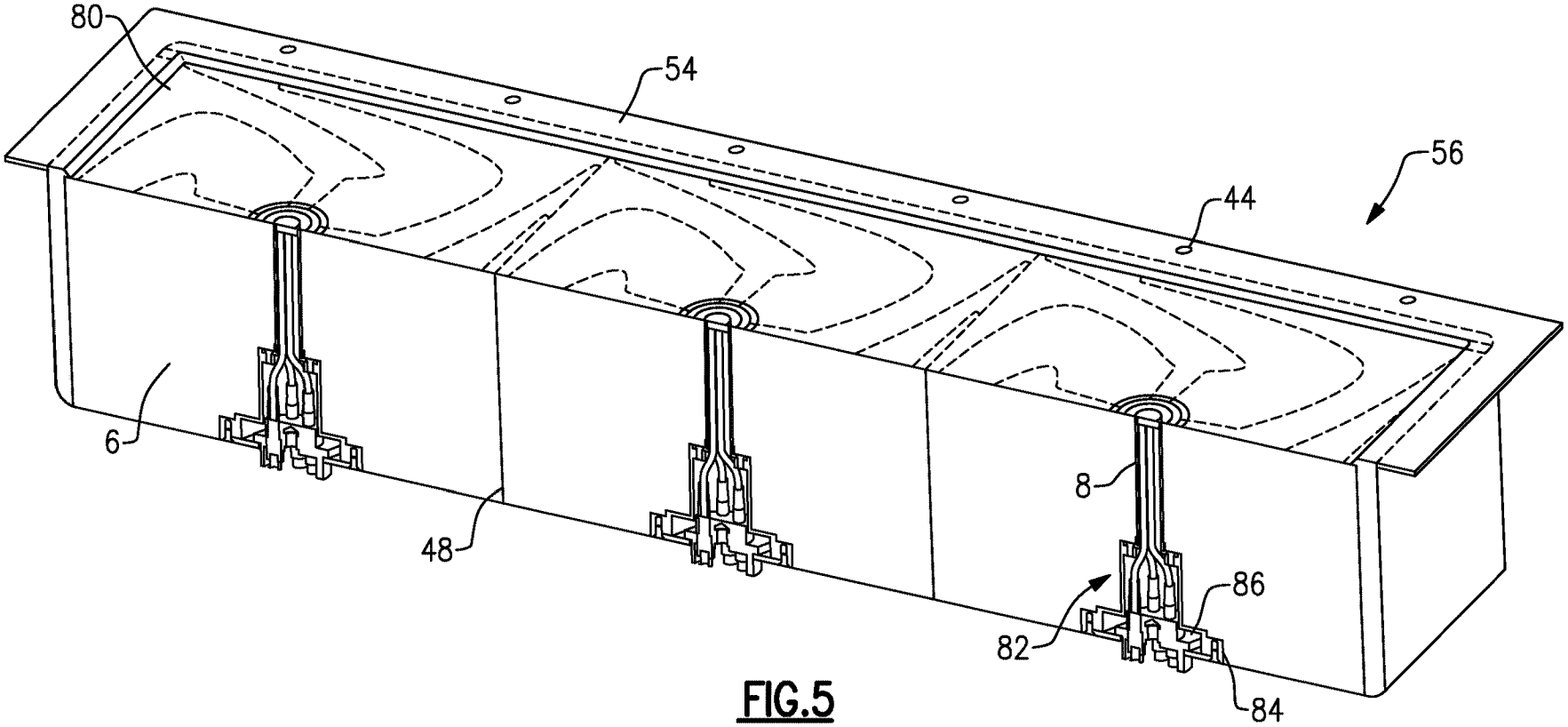
FIG. 5 shows a cross-sectional view of a three cube assembly with feed supplies according to the principles of the present disclosure.

Referring to FIG. 5, a cross-sectional view of a three-cube assembly with feed tubes according to the principles of the present disclosure is shown. More specifically, the entire assembly 56 (e.g. 3 cubes) is skinned in a fiberglass shell with a metalized fabric and cured in an autoclave as one then inseparable assembly. Metal grommets 44 with captive stud bolts are installed to provide connectivity when the antenna is installed. 80 is a recess from the mounting flange to the antenna face which provides some protection to the solder joint connections which are slightly blistered above the antenna face (this blister area would otherwise be exposed and sit above all other surfaces on the antenna). 82, 84, and 86 show all the bonding surfaces of the feed assembly 8 into the foam. The bond line of the individual cubes 48 is also shown. A mounting flange 54 of the overall assembly provides a rigid picture frame for the entire structure and accepts the grommets and stud bolts.

Figure 6:
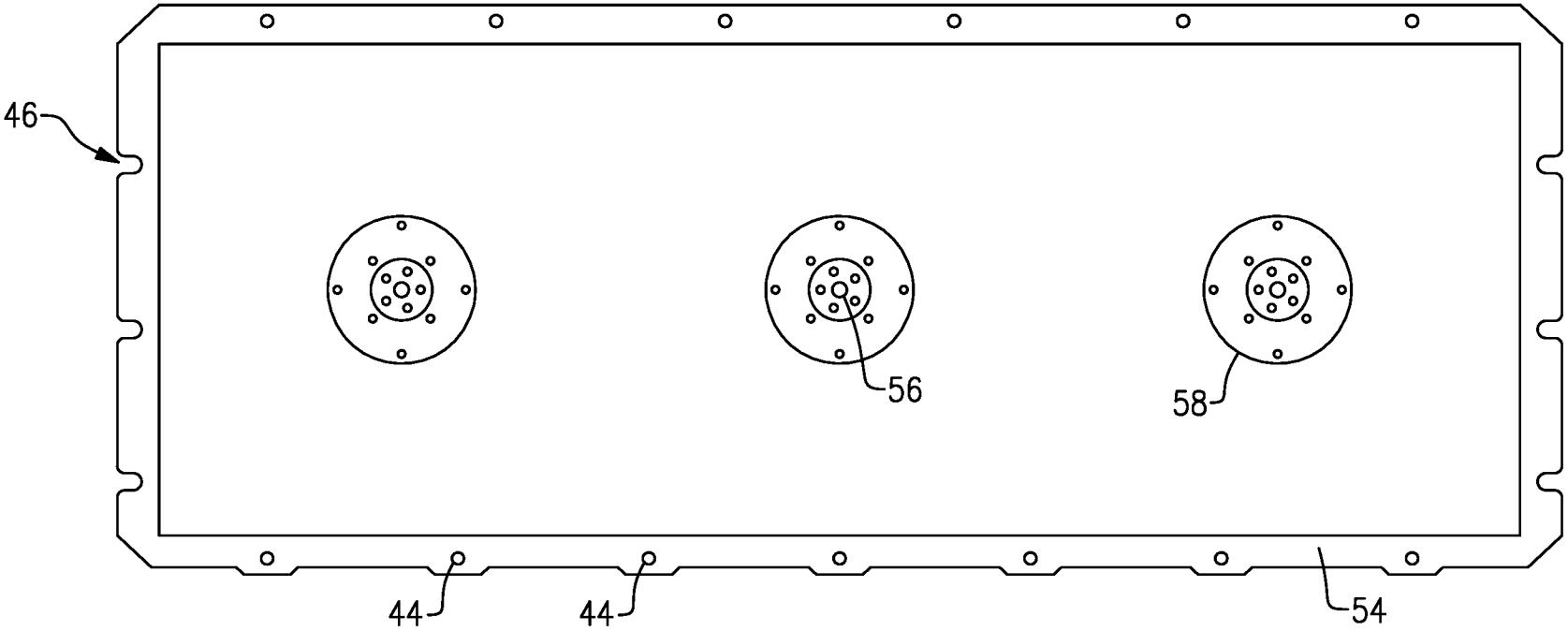
FIG. 6 shows a bottom view of an assembled embodiment of a three cube assembly according to the principles of the present disclosure.

Referring to FIG. 6, a bottom view of an assembled embodiment of a three cube assembly according to the principles of the present disclosure is shown. More specifically, a full antenna assembly 56 comprises multiple feed assemblies embedded in multiple blocks. Each block comprises multiple elements wrapped around foam core. A flange 54 comprises grommets and stud bolts (44) for use in grounding and attachment. Mounting plates 58 (item 22 in FIG. 2B) are used to pinch the conductive fabric of the fiberglass shell to the feed assembly body which provides the continuous conductive path from the mounting flange 54 grommets 44 to the feed assembly.

Figure 7A:
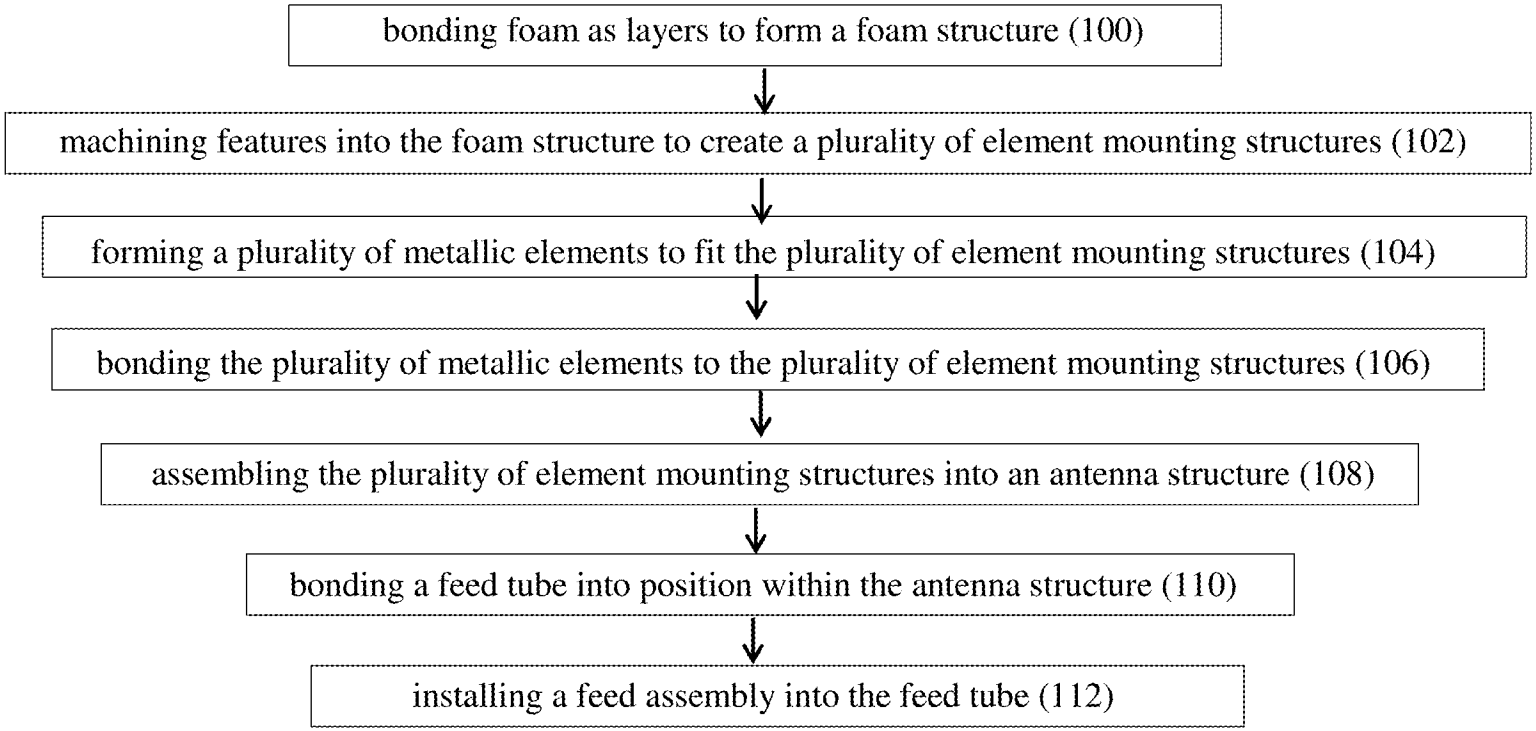
FIG. 7A and FIG. 7B are a flowchart of one embodiment of a method of manufacture according to the principles of the present disclosure.

Referring to FIG. 7A, a flowchart of one embodiment of a method of manufacture according to the principles of the present disclosure is shown. More specifically, foam is bonded together as layers to form a foam structure 100 and features are machined into the foam structure to create a plurality of element mounting structures 102. A plurality of metallic elements is formed to fit the plurality of element mounting structures 104. The plurality of metallic elements is bonded to the plurality of element mounting structures 106. The plurality of element mounting structures is then assembled into an antenna structure 108. A feed tube is bonded into position within the antenna structure 110 for installing a feed assembly into the feed tube 112.

Figure 7B:
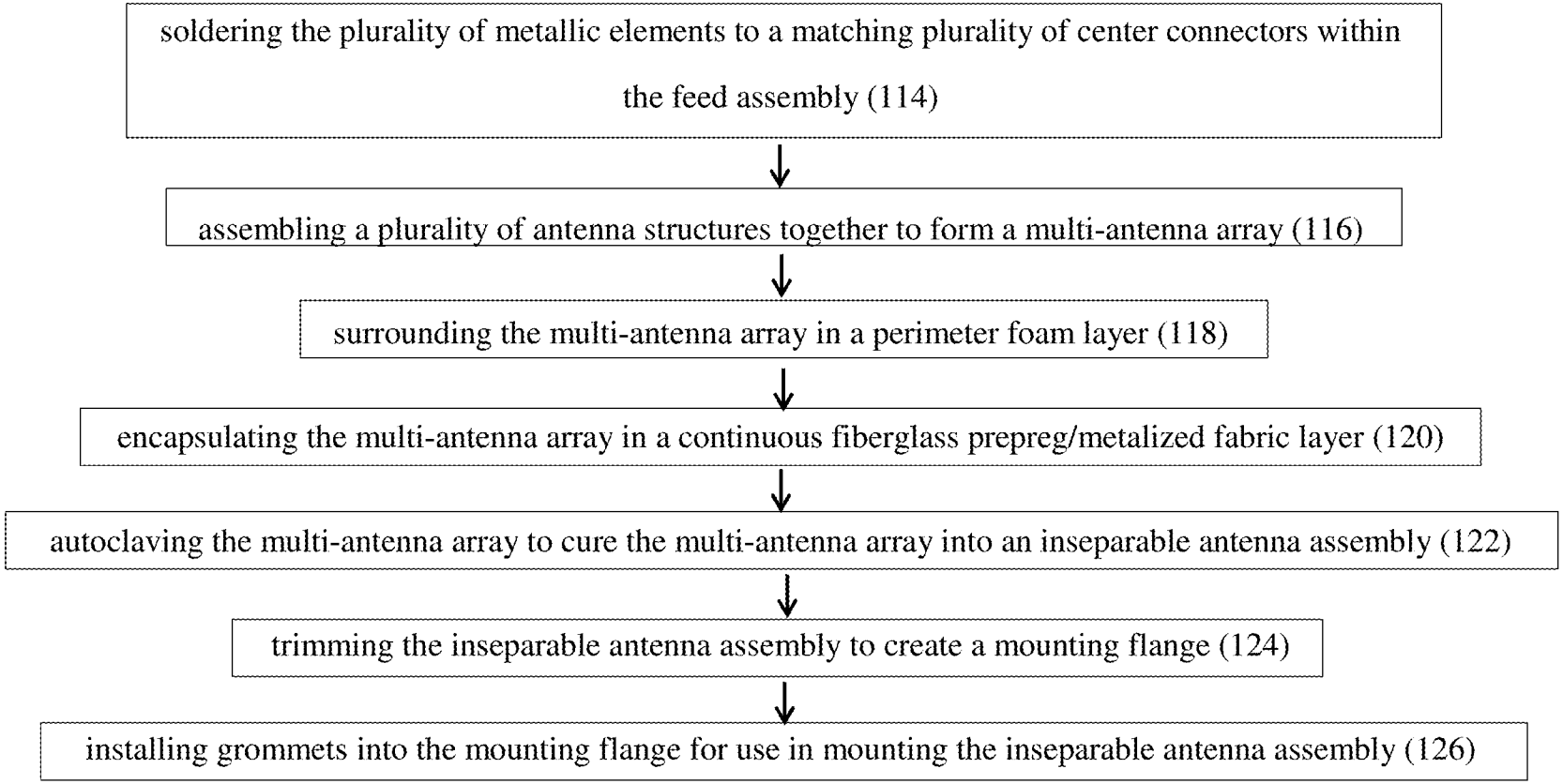

Referring to FIG. 7B, a flowchart of one embodiment of a method of manufacture according to the principles of the present disclosure is shown. More specifically, once the feed assembly is installed, the plurality of metallic elements is soldered to a matching plurality of center connectors within the feed assembly 114. A plurality of antenna structures can be assembled together to form a multi-antenna array 116, where the multi-antenna array is surrounded in a perimeter foam layer 118. The multi-antenna array is encapsulated in a continuous fiberglass prepreg/metalized fabric layer 120 and autoclaved to cure the multi-antenna array into an inseparable antenna assembly 122. The inseparable antenna assembly is trimmed to create a mounting flange 124 and grommets are installed into the mounting flange for use in mounting the inseparable antenna assembly 126.

Figure 8:
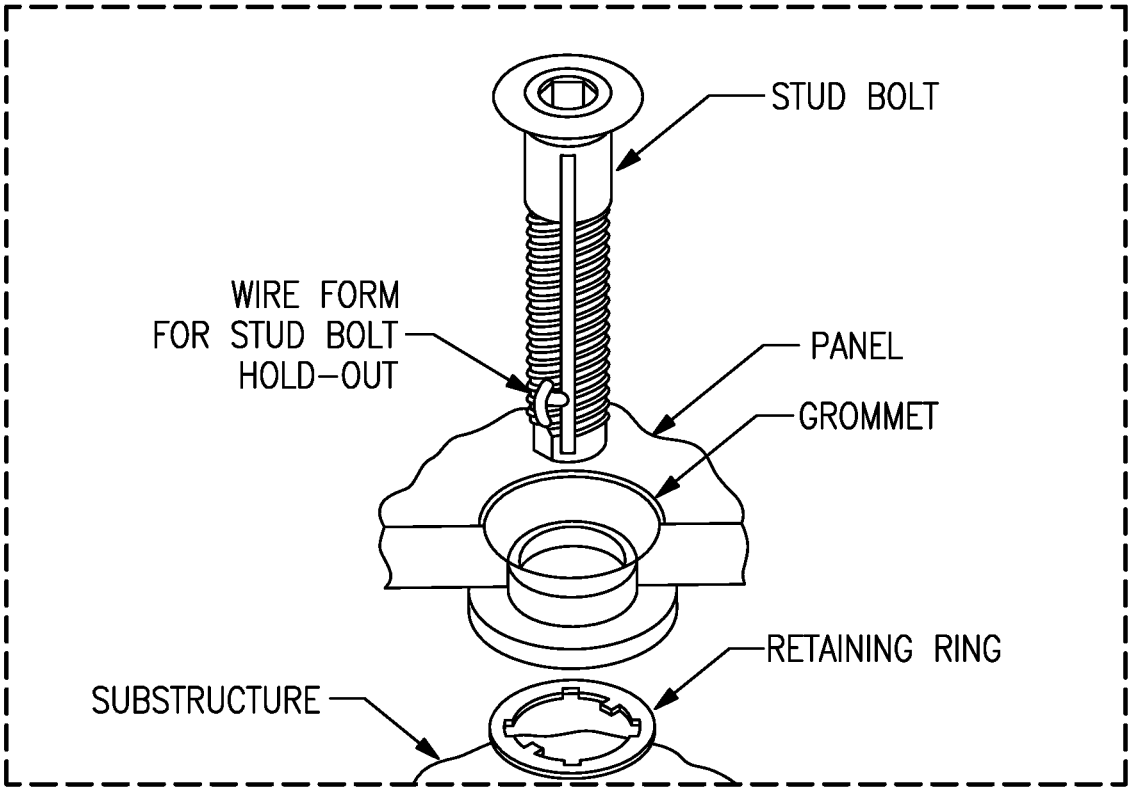
FIG. 8 is an expanded view of one embodiment of a connection for the assembled antenna.

Referring to FIG. 8, an expanded view of one embodiment of a typical grommet with stud bolt installation into the mounting flange for the assembled antenna is shown.

Figure 9:
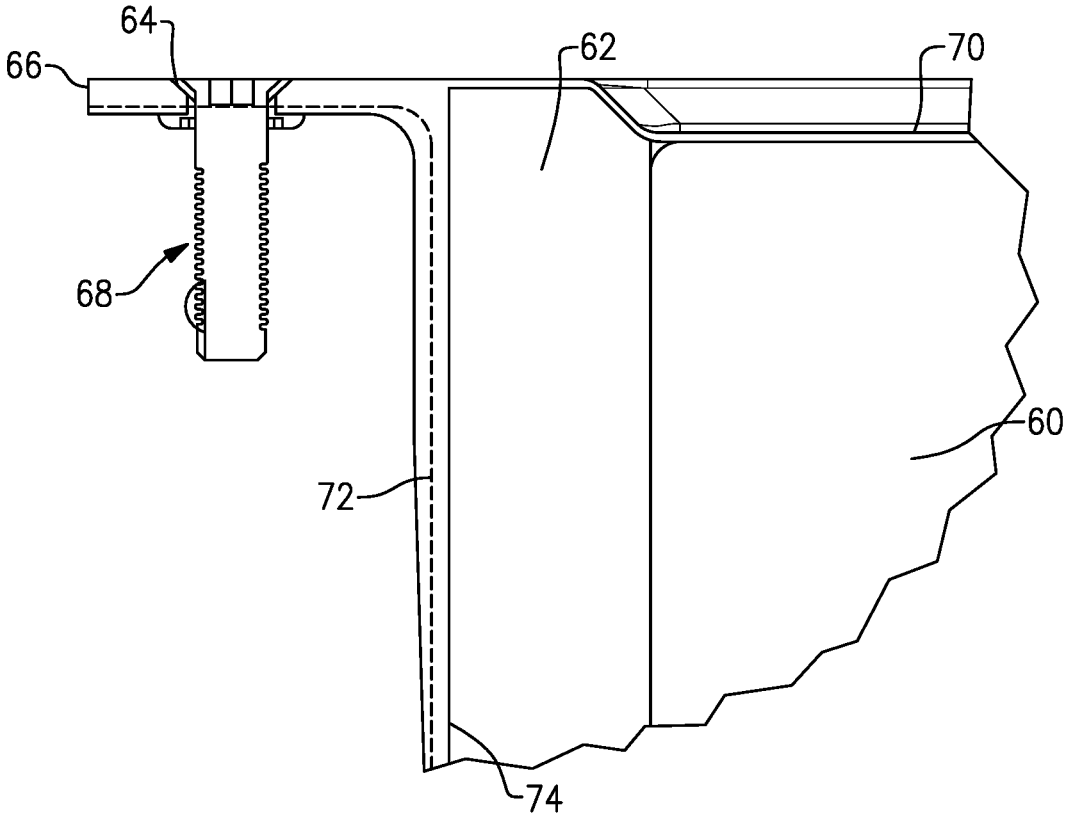
FIG. 9 is a cross-sectional view of a portion of one embodiment of the assembled antenna packaging.

Referring to FIG. 9, a cross-sectional view of a portion of one embodiment of the assembled antenna packaging is shown. More specifically, a foam core 60 is shown adjacent to a perimeter foam core 62. Metal grommets 64 are present in the flange 66. In some embodiments, the flange comprises eleven layers of pre-preg and one layer of conductive fabric/screen. When the grommets 64 are swaged in at installation, they pick up the conductive layer. Captive stud bolts 68 are used to mount the assembled antenna. In certain embodiments, three layers 70 of fiberglass skin (e.g. prepreg) are used. An embedded single layer of conductive fabric/screen 72 is continuous over the entire skin. In some cases, the skin tapers to three layers of prepreg and one layer of conductive fabric/screen 74.

Figure 10:
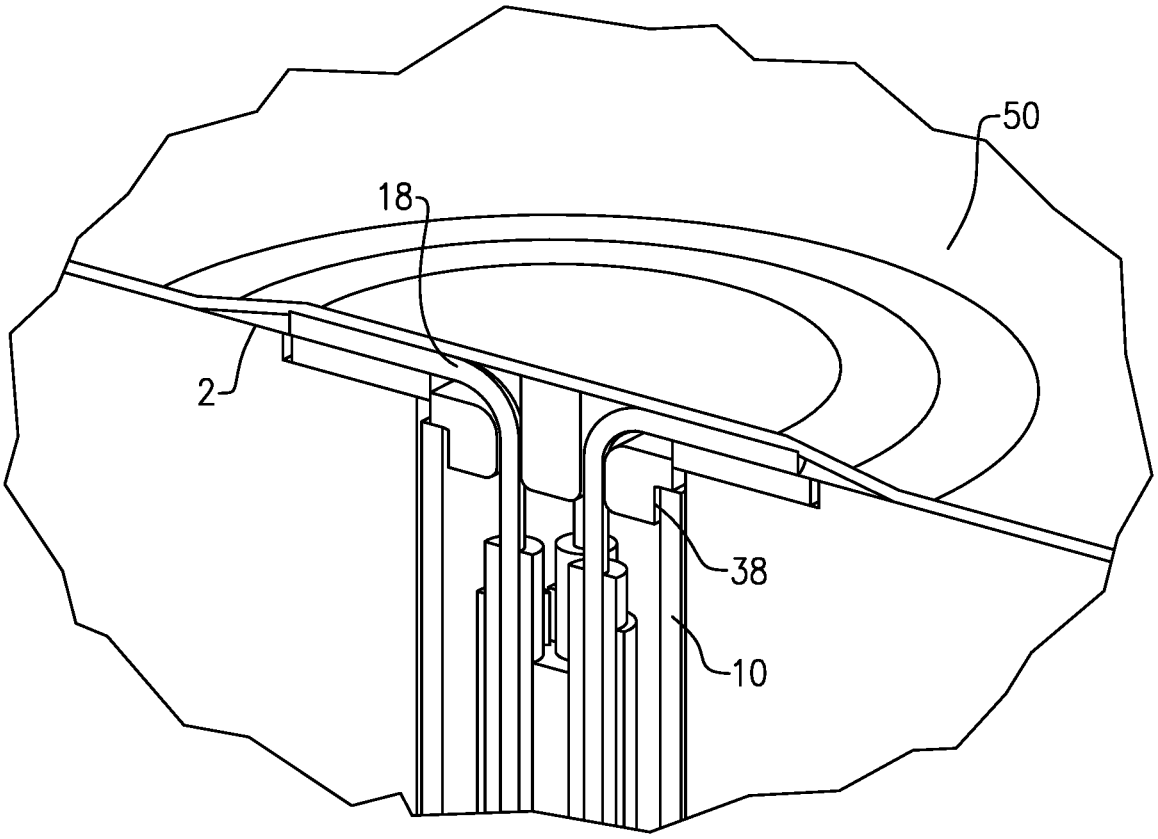
FIG. 10 is a magnified view of the attachment of the feed assembly for one embodiment of the present disclosure.

Referring to FIG. 10, a magnified view of the attachment of the feed assembly for one embodiment of the present disclosure is shown. More specifically, the element 2 is shown in contact with the center connector 18 and covered by the fiberglass skin 50. The non-conductive cap 38 that accurately positions and orients the cable center conductors 18 ensures they do not touch the feed housing 10 which is conductive.

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed is:

1. A lightweight spiral antenna array packaging method, comprising:

bonding foam as layers to form a foam structure;

machining features into the foam structure to create a plurality of element mounting structures;

forming a plurality of metallic elements to fit the plurality of element mounting structures;

bonding the plurality of metallic elements to the plurality of element mounting structures;

assembling the plurality of element mounting structures into an antenna structure;

bonding a feed tube into position within the antenna structure;

installing a feed assembly into the feed tube;

soldering the plurality of metallic elements to a matching plurality of center connectors within the feed assembly;

assembling a plurality of antenna structures together to form a multi-antenna array;

surrounding the multi-antenna array in a perimeter foam layer;

encapsulating the multi-antenna array in a continuous fiberglass prepreg/metalized fabric layer;

autoclaving the multi-antenna array to cure the multi-antenna array into an inseparable antenna assembly;

trimming the inseparable antenna assembly to create a mounting flange; and installing grommets into the mounting flange for use in mounting the inseparable antenna assembly.

2. The lightweight spiral antenna array packaging method according to claim 1, wherein the foam is polymethacrylimide (PMI).

3. The lightweight spiral antenna array packaging method according to claim 1, wherein the metallic elements are the copper foil which is 0.005 inches thick.

4. The lightweight spiral antenna array packaging method according to claim 1, wherein the plurality of metallic elements is four and the plurality of antenna structures is three.

5. The lightweight spiral antenna array packaging method according to claim 1, wherein bonding uses an adhesive.

6. The lightweight spiral antenna array packaging method according to claim 1, further comprising testing the inseparable antenna assembly.

7. The lightweight spiral antenna array packaging method according to claim 1, further comprising painting the inseparable antenna assembly.

8. A lightweight spiral antenna array package, comprising:

a foam structure comprising bonded foam layers, the foam structure having machined features to create a plurality of element mounting structures;

a plurality of metallic elements formed to fit the plurality of element mounting structures, where the plurality of metallic elements are bonded to the plurality of element mounting structures; and the plurality of element mounting structures are assembled into an antenna structure;

a feed tube bonded into a position within the antenna structure with a feed assembly within the feed tube;

the plurality of metallic elements are soldered to a matching plurality of center connectors within the feed assembly;

the antenna structure is surrounded by a perimeter foam layer and encapsulated in a continuous fiberglass prepreg/metalized fabric layer.

9. The lightweight spiral antenna array package according to claim 8, further comprising a plurality of antenna structures are assembled together to form an inseparable multi-antenna array.

10. The lightweight spiral antenna array package according to claim 9, further comprising a mounting flange comprising grommets for use in mounting the inseparable antenna assembly.

11. The lightweight spiral antenna array package according to claim 8, wherein the foam is polymethacrylimide (PMI).

12. The lightweight spiral antenna array package according to claim 8, wherein the metallic elements are the copper foil which is 0.005 inches thick.

13. The lightweight spiral antenna array package according to claim 8, wherein the plurality of metallic elements is four and the plurality of antenna structures is three.

14. The lightweight spiral antenna array package according to claim 8, wherein bonding uses an adhesive.

* * * * *